United States Patent [19]

Piretti

[11] Patent Number: 4,848,245

[45] Date of Patent: Jul. 18, 1989

[54] TABLE WITH SEPARABLE LEGS

[75] Inventor: Giancarlo Piretti, Bologna, Italy

[73] Assignee: B&B Italia S.p.A., Novedrate, Italy

[21] Appl. No.: 242,255

[22] Filed: Sep. 9, 1988

[30] Foreign Application Priority Data

Sep. 10, 1987 [IT] Italy ..... 67772 A/87

[51] Int. Cl.[4] ..... A47B 3/06

[52] U.S. Cl. ..... 108/156; 248/188.8; 403/391

[58] Field of Search ..... 108/154, 156; 403/391, 403/399, 396, 400; 248/188.8, 188, 188.1

[56] References Cited

U.S. PATENT DOCUMENTS

| | | | |
|---|---|---|---|
| 3,958,517 | 5/1976 | Jay | 248/188 X |
| 4,066,371 | 1/1978 | Chapman | 403/391 X |
| 4,242,969 | 1/1981 | Checkwood et al. | 108/156 X |
| 4,562,986 | 1/1986 | Frascaroli et al. | 248/188.1 |
| 4,597,140 | 7/1986 | Girard | 403/391 X |
| 4,793,580 | 12/1988 | Richards | 108/156 X |

FOREIGN PATENT DOCUMENTS

| | | | |
|---|---|---|---|
| 1239236 | 7/1960 | France | 108/156 |

*Primary Examiner*—Peter A. Aschenbrenner
*Attorney, Agent, or Firm*—Sughrue, Mion, Zinn, Macpeak & Seas

[57] ABSTRACT

A table comprises a table-top and a plurality of legs fixed to the table-top by means of a plurality of joints which are also used for supporting and interconnecting a series of horizontal cross members extending beneath the table-top. Each joint comprises a base element fixed to the lower surface of the table-top and having a seat in which the upper end of the respective leg is received and clamped by means of a wedge, and a cover fixed to the base element. The facing surfaces of the base element and the cover have recesses which cooperate with each other to define one or more seats in which the corresponding parts of the horizontal cross members are received and clamped.

4 Claims, 5 Drawing Sheets

FIG. 10
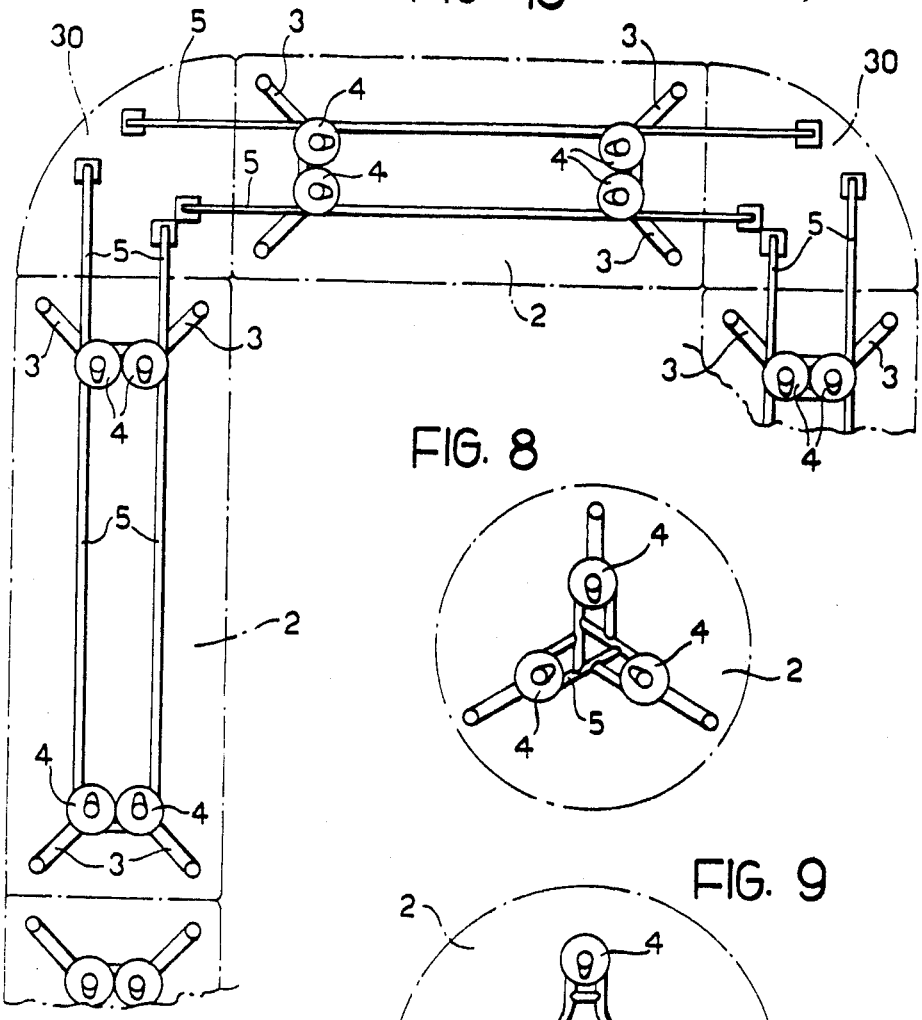
FIG. 8
FIG. 9
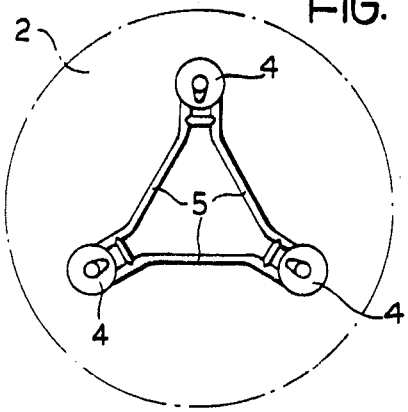

TABLE WITH SEPARABLE LEGS

DESCRIPTION

The present invention relates to tables, particularly but not exclusively office tables.

The object of the invention is to produce a table which has a structure that is simple to construct and easy and quick to assemble, which is aesthetically original, and which lends itself to assuming a plurality of different configurations.

In order to achieve this object, the subject of the invention is a table characterised in that the legs are fixed to the table-top by means of a plurality of joints which are also used for supporting and interconneting a series of horizontal cross members extending beneath the table-top, in that each joint comprises a base element fixed to the table-top and having a seat in which the upper end of the respective leg is received and clamped, and a cover fixed to the base element, and in that the facing surfaces of the base element and the cover of each joint have recesses which cooperate with each other to define one or more seats in which the corresponding parts of the horizontal cross members are received and clamped.

Figure 1:
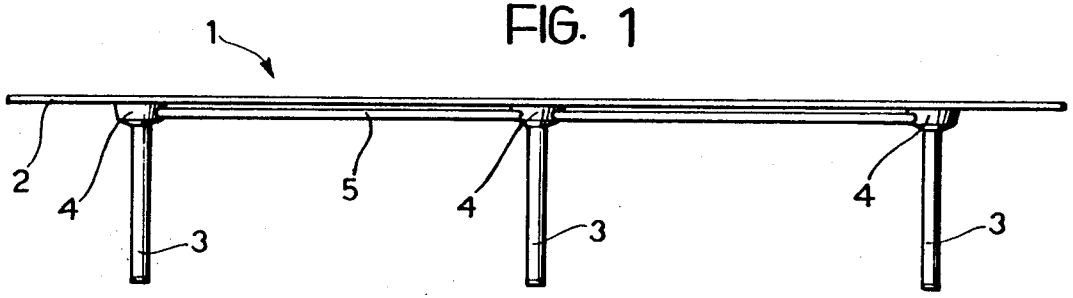
Figure 2:
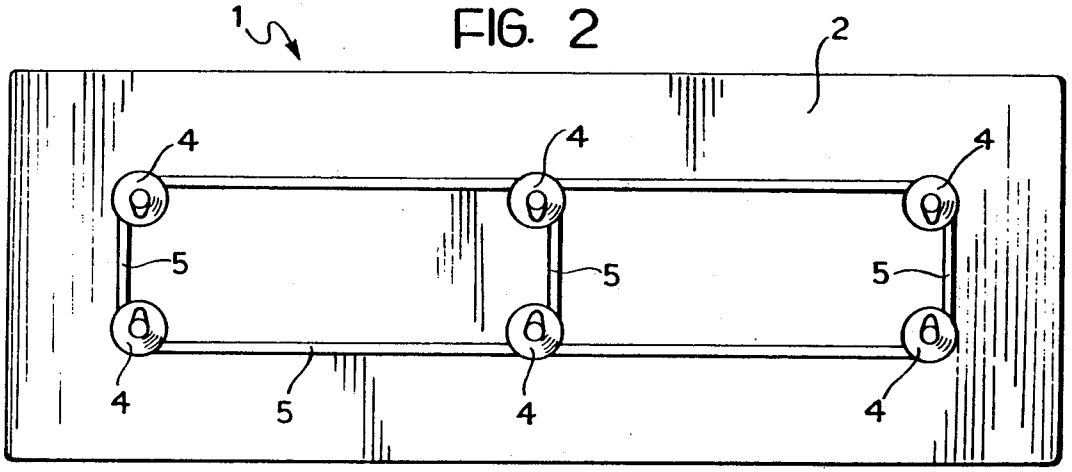
Figure 3:
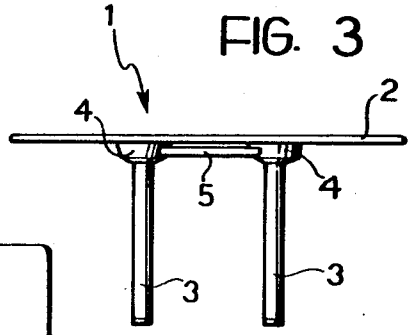
Figure 4:
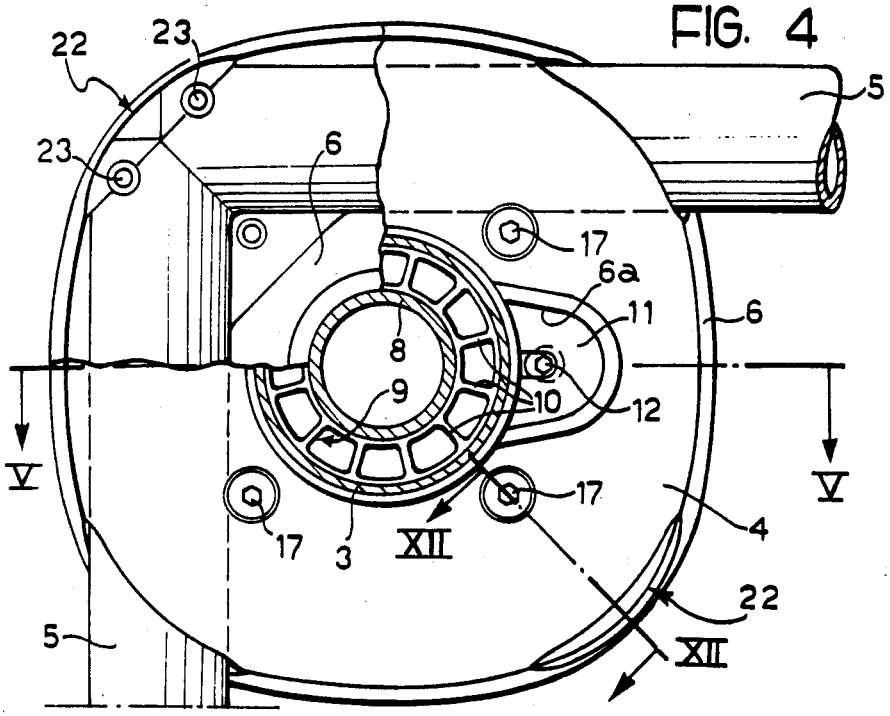
Figure 5:
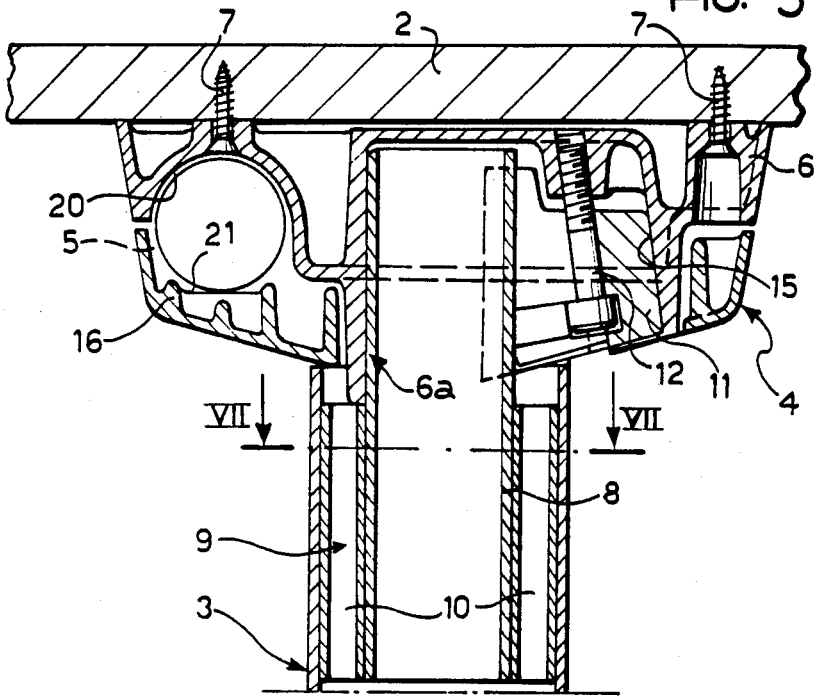
Figure 6:
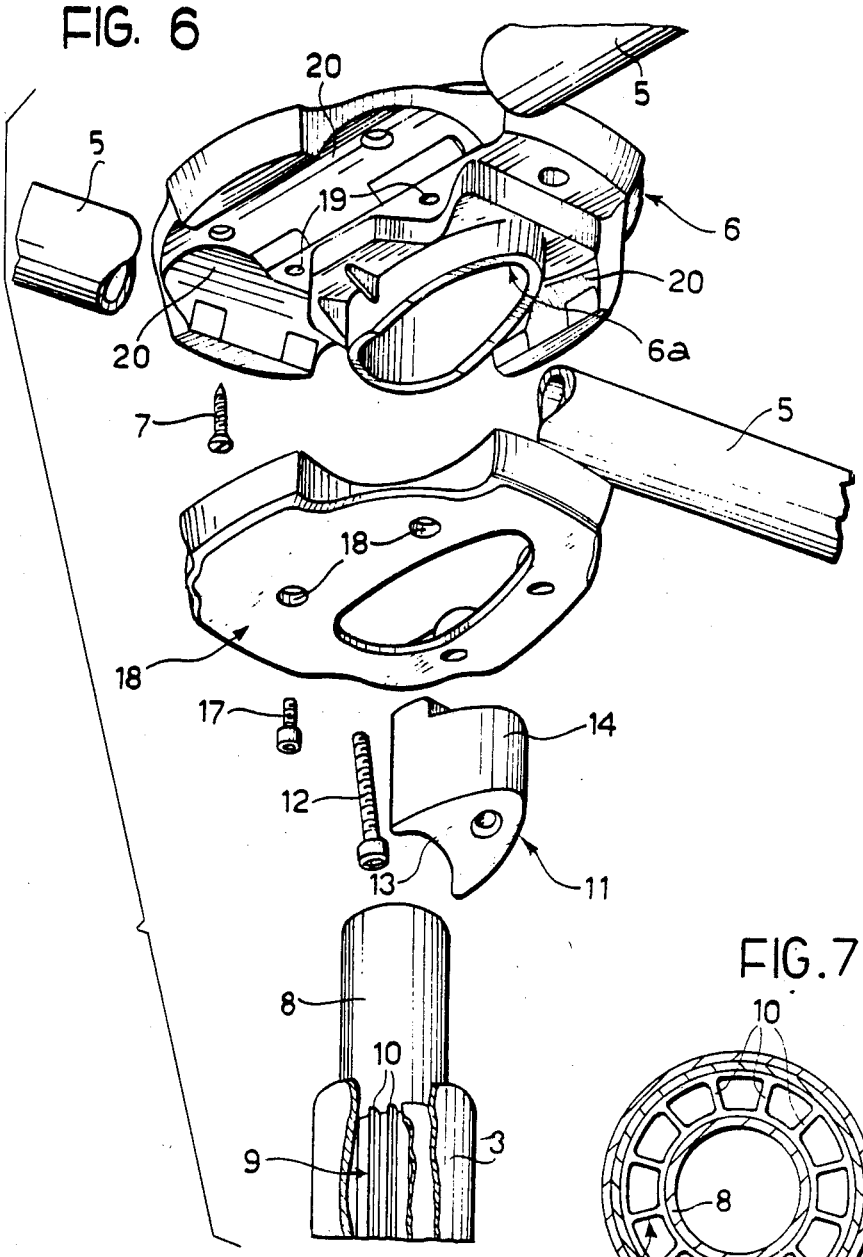
Figure 7:
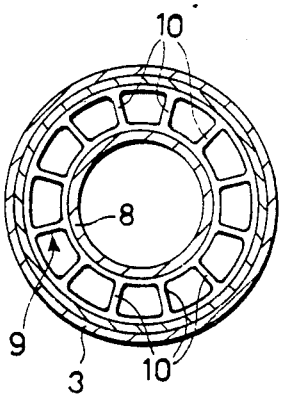
Figure 11:
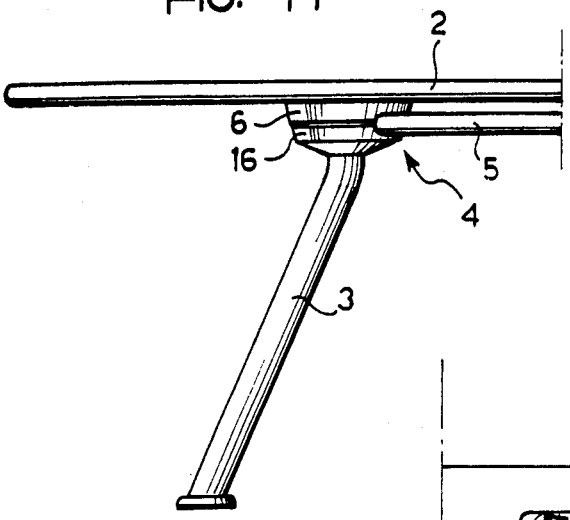
Figure 12:
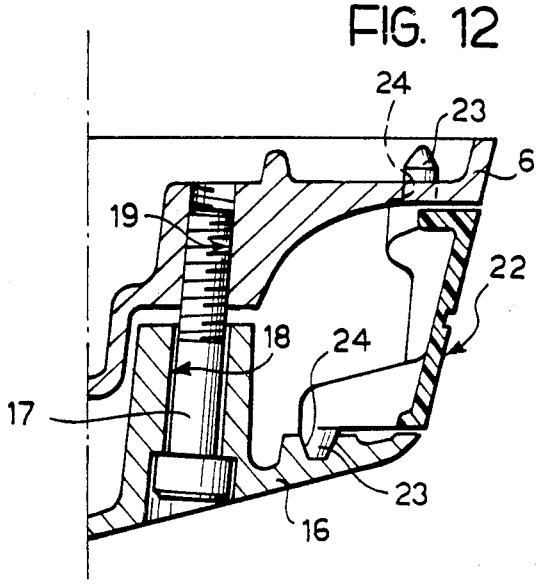
Figure 13:
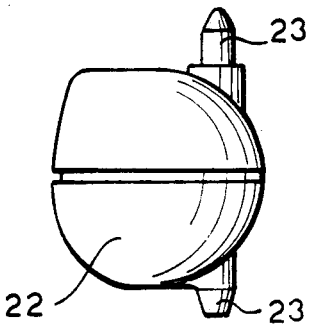

The invention will now be described with reference to the appended drawings provided purely by way of non-limiting example, in which:

FIGS. 1, 2 and 3 are a side view, a view from below and an end view of a first embodiment of the table according to the invention, FIG. 4 is a view from below of a joint forming part of the table according to the invention, on an enlarged scale, FIG. 5 is a section taken on the line V—V of FIG. 4, FIG. 6 is an exploded perspective view of the detail of FIG. 5, FIG. 7 is a section taken on the line VII—VII of FIG. 5, FIGS. 8, 9, 10 and 11 show four possible variants of the table according to the invention, FIG. 12 is a section taken on the line XII—XII of FIG. 4, and FIG. 13 is a front view of the detail of FIG. 12.

With reference to FIGS. 1–7, a table is generally indicated 1 and has a table-top 2, which is of wood in the embodiment illustrated, and a plurality of supporting legs 3. The legs 3 are fixed to the table-top 2 by means of joints 4 which are also used for supporting and interconnecting a plurality of horizontal cross members 5 which extend beneath the table-top 2 at a short distance therefrom.

As can be seen particularly in FIGS. 5 and 6, each joint 4 includes a base element 6 (which, in the example illustrated, is of light alloy) fixed against the lower surface of the table-top 2 by screws 7. The base element 6 incorporates a central seat 6*a* in which the upper end of a circular-sectioned tubular element 8 projecting from the upper end of the leg 3 is received. The leg 3 is constituted by a tubular element of circular section. The tubular element 8 is inserted coaxially into the leg 3 with the interposition of a spacer bush 9, also of light alloy, having a plurality of radial walls 10 (FIG. 7). The bush 9 is glued to the element 8 and to the leg 3. The use of bushes of different outside diameters enables the table to be adapted to legs of various diameters. The upper end of the tubular element 8 is clamped in the seat 6a by means of a clamping wedge 11 which can be clamped to the base element 6 by means of a screw 12. The wedge 11 has a curved face 13 in contact with the surface of the tubular element 8 and an opposite face 14 which is complementary in shape to the corresponding surface 15 of the seat 6*a*. The tightening of the screw 12 into the base element 6 causes the body 11 to be wedged into the space between the wall of the seat 6*a* and the tubular element 8, so as to clamp the latter in the seat 6*a*.

A cover 16 is fixed to the base element 6 by means of screws 17 (FIG. 6) which engage holes 18, 19 in the cover 16 and in the base element 6.

Along three sides of the joint, the lower surface of the base element 6 has elongate cavities of semicircular profile, indicated 20 in the drawings. These recesses cooperate with corresponding cavities 21 formed in the upper surface of the cover 16 (FIG. 5) to define three seats in which three respective horizontal cross members 5 can be received and clamped. FIG. 6 shows the case in which the joint 4 is at a T-intersection of two cross members 5. FIG. 5 shows the case of an angled intersection. As can be seen, the apertures of the joint which are not in use are closed by plastics covers 22 (FIGS. 12, 13) having appendages 23 which are housed in seats 24 of the elements 6, 16.

FIGS. 8 and 9 show two variants of the table according to the invention, in which the table-top 2 is circular in shape and in which the conformation of the horizontal cross members 5 varies from that described above.

The table according to the invention also lends itself to the production of integrated structures constituted by several tables, such as that illustrated in FIG. 10. In this case, the structure also includes corner elements 30 supported by those ends of the horizontal cross members 5 which project from the adjacent table. Finally, it is possible to use inclined legs, as illustrated in FIG. 11.

Naturally, the principle of the invention remaining the same, the forms of embodiment and details of construction may be varied widely with respect to those described and illustrated purely by way of example.

I claim:

1. A table comprising a table-top and a plurality of legs fixed to the table-top, wherein:

it further includes a series of horizontal cross members extending beneath the table-top, and a plurality of joints which fix the legs to the table-top and support and interconnect the horizontal cross members, each joint comprises a base element fixed to the lower surface of the table-top and defining a seat in which the upper end of the respective leg is received and clamped, and a cover fixed to the base element, and the base element and the cover of each joint have facing surfaces with recesses which cooperate with each other to define one or more seats in which the corresponding parts of the horizontal cross members are received and clamped.

2. A table according to claim 1, wherein the upper end of each leg is fixed in the seat of the respective base element by means of a clamping wedge which can be screwed to the base element.

3. A table according to claim 1, wherein a connecting element projects from the upper end of each leg and is engaged in the seat of the respective base element, and a bush is interposed between the connecting element and the upper end of the leg to fix the connecting element therein.

4. A table according to claim 1, wherein plastics covers are provided to close those seats of the joint through which no cross member passes in use.

* * * * *